US005766030A

United States Patent [19]

Suzuki

[11] Patent Number: 5,766,030

[45] Date of Patent: Jun. 16, 1998

[54] CAP TYPE CONNECTOR ASSEMBLY FOR HIGH-VOLTAGE CABLE

[75] Inventor: Takahiko Suzuki, Gotenba, Japan

[73] Assignee: Yazaki Corporation, Tokyo, Japan

[21] Appl. No.: 757,168

[22] Filed: Nov. 27, 1996

[30] Foreign Application Priority Data

Dec. 25, 1995 [JP] Japan ..... 7-336867

[51] Int. Cl.[6] ..... H01R 13/52

[52] U.S. Cl. ..... 439/282; 439/921

[58] Field of Search ..... 439/281, 282, 439/350, 357, 921

[56] References Cited

U.S. PATENT DOCUMENTS

| | | | |
|---|---|---|---|
| 3,678,432 | 7/1972 | Boliver | 439/921 X |
| 3,880,487 | 4/1975 | Goodman et al. | 439/282 |
| 4,713,015 | 12/1987 | Takiguchi | 439/125 |
| 5,302,131 | 4/1994 | Heritier-Best et al. | 439/127 |

FOREIGN PATENT DOCUMENTS

| | | |
|---|---|---|
| 0 328 467 | 8/1989 | European Pat. Off. . |
| 57-9170 | 1/1982 | Japan . |
| 4-131876 | 12/1992 | Japan . |
| 2 029 128 | 3/1980 | United Kingdom . |
| 2 203 297 | 10/1988 | United Kingdom . |
| 2 212 992 | 8/1989 | United Kingdom . |
| 2 254 493 | 10/1992 | United Kingdom . |

OTHER PUBLICATIONS

UK Patent Office Comunication with attached search report for UK application No. GB 9625105.3, dated Jan. 30, 1997.

*Primary Examiner*—Khiem Nguyen

*Attorney, Agent, or Firm*—Armstrong, Westerman, Hattori, McLeland & Naughton

[57] ABSTRACT

A cap type connector assembly includes a cap and an opposite terminal receiving tower. The cap receives a terminal fitting therein and has an entry opening for the high-voltage cable at one end thereof and an open casing for inserting the terminal receiving tower at the other end thereof. The open casing of the cap has a tubular portion covering the terminal fitting therein and a locking hook inside the open casing. The terminal receiving tower has a receiving portion at its fore end and a locking projection formed in its outer periphery surface. The receiving portion receives the inner tubular portion and the locking hook engages with the locking projection to seal the terminal receiving tower. The tubular portion of the cap may have an external shape of a truncated cone and the receiving portion of the terminal receiving tower may have a forwardly divergent, conical inner surface.

2 Claims, 1 Drawing Sheet

CAP TYPE CONNECTOR ASSEMBLY FOR HIGH-VOLTAGE CABLE

BACKGROUND OF THE INVENTION

1. Field of the Invention

This invention relates to a high-voltage cable, and particularly to a connector assembly including a cap type connector fitted to one end of a high-tension cable and an opposite terminal receiving tower such as a distributor entry tower, which are used in an ignition circuit for an internal combustion engine.

2. Description of the Prior Art

A high-tension cable used for an ignition circuit of an automobile engine or the like has a cap fitted to one end thereof. The cap covers and is coupled to a terminal receiving tower constituting an entry of a distributor (which may contain an ignition coil). The cap includes a terminal fitting made contact with an opposing terminal in the terminal receiving tower.

FIG. 2 shows a previously known cap type connector assembly, in which a terminal receiving tower with a slightly reduced sized fore end as compared with its base portion. The terminal receiving tower is an entry of a distributor and is coupled with a sealing portion c formed in a cap b attached to one end of a high-tension cable H. Further, an outer peripheral surface of the terminal receiving tower a is brought into secure contact with an inner peripheral surface of the sealing portion c.

However, when the terminal receiving tower a is short in its height h, the sealing between the terminal receiving tower a and the cap b may possibly be insufficient. Further, the cap is retained both by a fastening force of the sealing portion c and a coupling force of the terminal fitting d inserted into the opposite terminal e. Thereby, the terminal fitting d requires a large insertion force to be inserted into the terminal e in the terminal receiving tower a. This decreases efficiency in coupling work of the cap and the terminal receiving tower and may not possibly confirm definitely their complete coupling.

Moreover, there is a gap g between an inner wall f of the cap b and the terminal fitting d. In use, this has a drawback that the terminal fitting d and the terminal e wear away at their contacting portions by vibration due to an internal combustion engine.

SUMMARY OF THE INVENTION

In view of the above-mentioned drawback, an object of the invention is to provide with a cap type connector assembly used for a high-voltage cable, which can seal efficiently an electric pole tower for a distributor and can provide a highly reliable and durable electrical connection.

For achieving the object, according to this invention, a cap type connector assembly used for a high-voltage cable includes a cap and an opposite terminal receiving tower, the cap receiving a terminal fitting therein and having an entry opening for the high-voltage cable at one end thereof and an open casing for inserting the terminal receiving tower at the other end thereof, the open casing of the cap having a tubular portion covering the terminal fitting therein and a locking hook inside the open casing, and the terminal receiving tower having a receiving portion at its fore end and a locking projection formed in its outer periphery surface, wherein the receiving portion receives the inner tubular portion and the locking hook engages with the locking projection to seal the terminal receiving tower.

The tubular portion of the cap may have an external shape of a truncated cone and the receiving portion of the terminal receiving tower may have a forwardly divergent, conical inner surface.

The locking hook and the locking projection may be annularly formed.

DETAILED DESCRIPTION OF PREFERRED EMBODIMENTS

A preferred embodiment of the invention will be discussed in the following.

Figure 1:
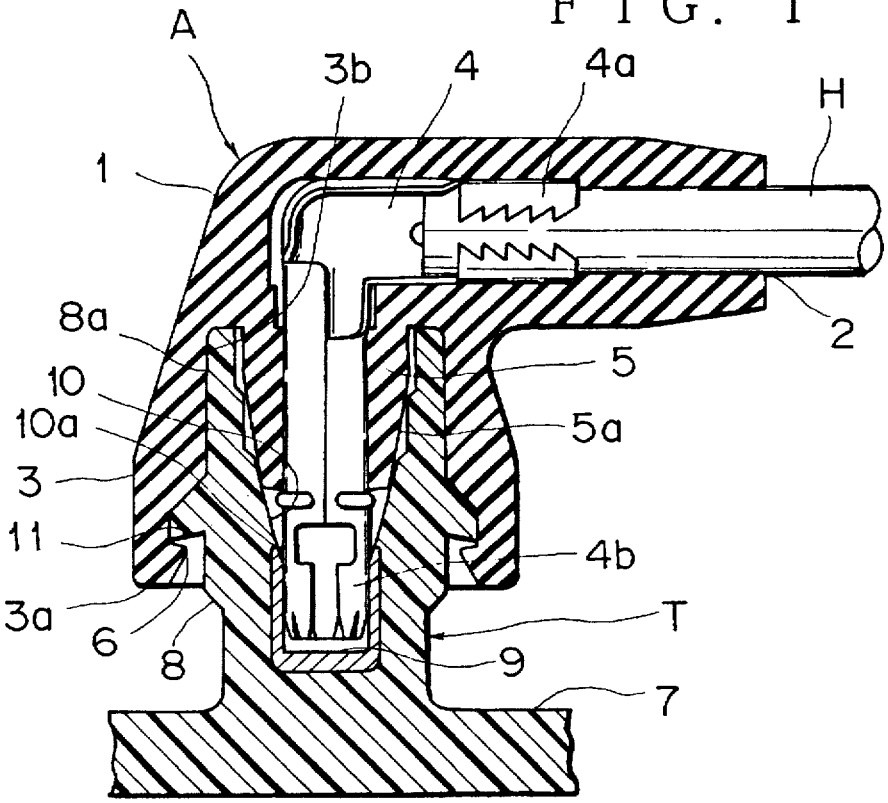
FIG. 1 is a longitudinal sectional view showing a cap type connector assembly of an embodiment according to the invention, in which a cap for a high-voltage cable has coupled with a terminal receiving tower for a distributor.
Figure 2:
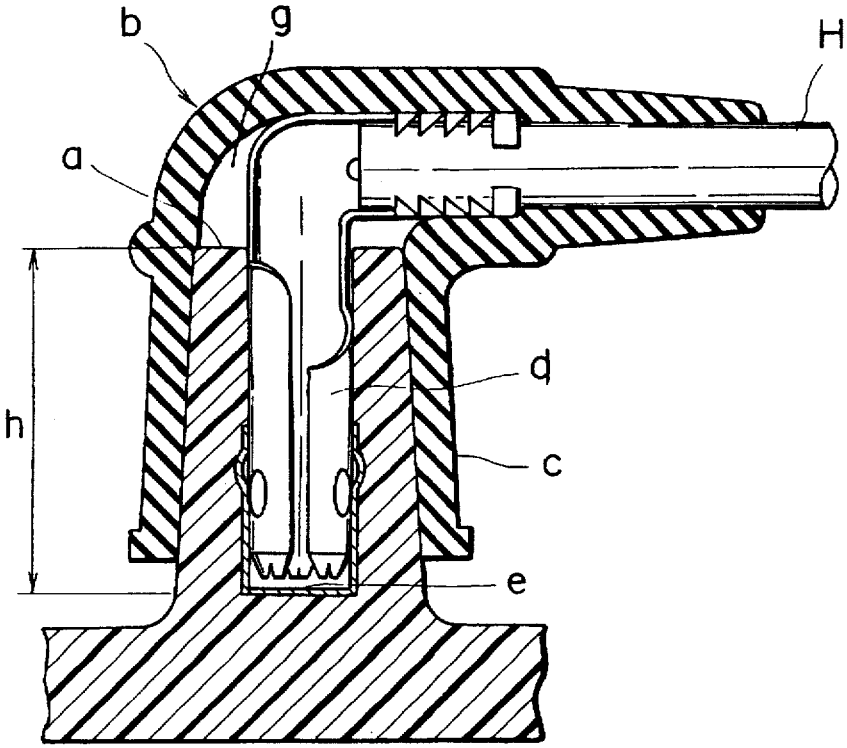
FIG. 2 PRIOR ART
FIG. 2 is a longitudinal sectional view showing a previously known cap type connector assembly, in which a cap for a high-voltage cable has coupled with a terminal receiving tower for a distributor.

FIG. 1 is a longitudinal sectional view showing a cap type connector assembly of an embodiment according to the invention, in which a cap A for a high-voltage cable has coupled with a terminal receiving tower T for a distributor used for an automobile engine.

The cap A has a L-shaped main body 1, at an end of which there is provided with an entry opening 2 for inserting a high-voltage cable H and at the other end of which there is provided with an open casing 3 for inserting the opposite terminal receiving tower T.

The cap A for the high-voltage cable receives a L-shaped tubular terminal fitting 4 therein. A wire connecting portion 4*a* of the terminal fitting 4 has connected with the high-voltage cable H.

Inside the open casing 3, there is provided with a truncated cone shaped internal casing 5. The terminal fitting 4 penetrates through the middle of the internal casing 5 and an electrical contacting portion 4*b* extends forward from an open end portion 3*a* of the open casing 3. The open end portion 3*a* has a locking hook 6 circumferentially formed in an inner periphery thereof.

The terminal receiving tower T for the distributor stands on a distributor casing 7 and is formed with a substantially cylindrical body 8. In the cylindrical body 8, there is mounted with a terminal barrel 9 electrically contacting with the terminal fitting 4 in the cap A for the high-voltage cable.

In an upper portion of the cylindrical body 8 there is formed with a receiving portion 10 having an outwardly divergent, conical inner surface. Further, an annular lower end 10*a* of the receiving portion 10 abuts against an annular fore end of the terminal barrel 9.

An outer peripheral surface 8*a* of the cylindrical body 8 has an annular locking projection 11. The locking projection 11 engages with the locking hook 6 formed in the cap A for the high-voltage cable so that the terminal receiving tower T is locked to the cap A for the high-voltage cable. Thereby, the terminal receiving tower T is locked securely to the cap A for the high-voltage cable, which eliminates such a trouble as falling-off of the cap in use.

In FIG. 1, the terminal receiving tower T has coupled with the cap A for the high-voltage cable. Further, the receiving portion 10 of the terminal receiving tower T has made secure contact with an outer peripheral surface 5*a* of the internal casing 5 in the cap A. Moreover, the fore end of the outer peripheral surface 8*a* of the terminal receiving tower T has made secure contact with an inner peripheral wall 3*b* of the open casing 3 of the cap A.

Accordingly, the terminal receiving tower T and the cap A for the high-voltage cable can constitute a double sealing structure, which improves their seal performance.

Operational effects of the invention will be described in the following.

In the cap type connector assembly according to the invention, the terminal receiving tower of the distributor can be better sealed. Further, the internal casing provided inside the cap for the high-voltage cable eliminates a useless gap between the terminal fitting and the cap for the high-voltage cable. This prevents the terminal fitting from being vibrated.

Accordingly, in use, the terminal will not wear off even if the terminal fitting receives vibration generated by the internal combustion engine. This remarkably improves electrical connection between the terminal and the opposite terminal fitting in reliability and durability.

Moreover, the locking hook formed in the open casing of the cap for the high-voltage cable engages and is locked to the locking projection formed on the terminal receiving tower. This requires only a small coupling force for coupling the cap with the terminal receiving tower. In addition, a worker can easily perceive the completion of the coupling by hand, which provides an advantage of a more efficient working process.

What is claimed is:

1. A cap type connector assembly for a high-voltage cable comprising:

an opposite terminal receiving tower, wherein said terminal receiving tower has a receiving portion at a fore end thereof and a locking projection formed in an outer peripheral surface thereof;

a cap, wherein said cap receives a terminal fitting therein and said cap has an entry opening for said high-voltage cable at a first end thereof and an open casing for inserting said terminal receiving tower at a second end thereof, said open casing of said cap having an inner tubular portion covering said terminal fitting therein and a locking hook inside said open casing;

wherein said receiving portion of said terminal receiving tower receives said inner tubular portion of said cap and said locking hook of said cap engages with said locking projection of said terminal receiving tower to seal said terminal receiving tower; and wherein said inner tubular portion of said cap has an external shape of a truncated cone and said receiving portion of said terminal receiving tower has a forwardly divergent, conical inner surface.

2. The cap type connector assembly as claimed in claim 1, wherein said locking hook and said locking projection are annularly formed.

* * * * *